US006659765B1

(12) United States Patent
Sen-Yu

(10) Patent No.: US 6,659,765 B1
(45) Date of Patent: Dec. 9, 2003

(54) INFRARED RAYS GAS BURNER

(75) Inventor: Wu Sen-Yu, Taichung Hsien (TW)

(73) Assignee: Seven Universe Industrial Co., Ltd., Taichung (TW)

( * ) Notice: Subject to any disclaimer, the term of this patent is extended or adjusted under 35 U.S.C. 154(b) by 0 days.

(21) Appl. No.: 10/321,639

(22) Filed: Dec. 18, 2002

(51) Int. Cl.[7] ..... F23D 14/12

(52) U.S. Cl. ..... 431/328; 431/354; 126/92 R; 126/92 AC

(58) Field of Search ..... 431/7, 328, 329, 431/354, 326; 126/92 R, 92 AC, 92 B, 92 C

(56) References Cited

U.S. PATENT DOCUMENTS 3,040,805 A * 6/1962 Lambert ..... 431/329
3,057,400 A * 10/1962 Wagner ..... 431/328
3,199,573 A * 8/1965 Flynn ..... 431/328
3,785,763 A * 1/1974 Bratko ..... 431/328
3,824,064 A * 7/1974 Bratko ..... 431/328
4,608,012 A * 8/1986 Cooper ..... 431/328
5,593,300 A * 1/1997 De Gouville ..... 431/354

* cited by examiner

*Primary Examiner*—James C. Yeung
(74) *Attorney, Agent, or Firm*—Dennison,Schultz & Dougherty

(57) ABSTRACT

An infrared rays gas burner comprises a main member having a box which has a base seat and a cover, two non-asbestos pads, ceramic planks and guiding device. The non-asbestos pads is mounted the base seat and the ceramic planks rests on the non-asbestos pad and the cover is secured to the base seat with stop portions thereon against the ceramic plank. A gas mixing tube, which works as a Venturi tube, is mounted on the base seat to inject gas into the base seat. The guiding device is mounted in the base seat, which has guiding portions and outlets thereon for spreading the gas injected from the gas mixing tube in the base seat equally.

14 Claims, 6 Drawing Sheets

INFRARED RAYS GAS BURNER

FIELD OF THE INVENTION

The present invention relates to a gas stove, and more particularly to a composite an infrared rays gas burner.

BACKGROUND OF THE INVENTION

A conventional infrared rayed gas burner was provided in a stove which burns gas to heat a ceramic plank so as to provide infrared rays for cooking foods. There were two types of infrared rayed gas burners presented in the market, one of which provided ceramic planks on a conventional gas burner to heat them directly, the other one of which provided an open type gas burner and fixed with ceramic planks thereon with galvanized iron nails. The gas burner of the second type is smaller and gas and air will be mixed well so that the second type of the conventional infrared rayed gas burner is popular in the present market.

It will be noted that the ceramic planks of the second type of the infrared rayed gas burner is fixed the with the gas burner by galvanized iron nails, therefore the ceramic planks are easy to be damaged when assembling, and, if the ceramic plank were damaged, all of them must be replaced and the replacement procedures are not an easy work.

SUMMARY OF THE INVENTION

The primary object of the present invention is to provide an infrared rays gas burner, which will not damage the ceramic planks.

The secondary object of the present invention is to provide an infrared rays gas burner, which has an easy way to assemble it.

The third object of the present invention is to provide an infrared rays gas burner, which can only replace parts of the ceramic planks which are damaged.

According to the objects of the present invention, an infrared rays gas burner comprises a main member having a box which has a base seat and a cover, at least a non-asbestos pad and at least a ceramic plank, wherein the base seat has an opening at a top side thereof, support portions at the top side thereof and a connecting opening and lock holes on an end thereof and the cover has an opening at a midsection thereof and stop portions at an edge of the opening. The non-asbestos pad rests on the support portions of the base seat and the ceramic plank rests on the non-asbestos pad and the cover is secured to the base seat with the stop portion against the ceramic plank. A gas mixing tube has an inner tube secured on an interior side of the base seat and an outer tube secured on an exterior side of the base seat, wherein the inner tube is communicated with the out tube via the connecting opening of the base seat, the inner tube having a tunnel therein which has a smaller size at the end thereof communicating the out tube and a larger size at the other end thereof and the outer tube having a tunnel therein which has a smaller size at the end thereof communicating the inner tube and a larger size at the other end thereof.

DETAIL DESCRIPTION OF THE INVENTION

Figure 1:
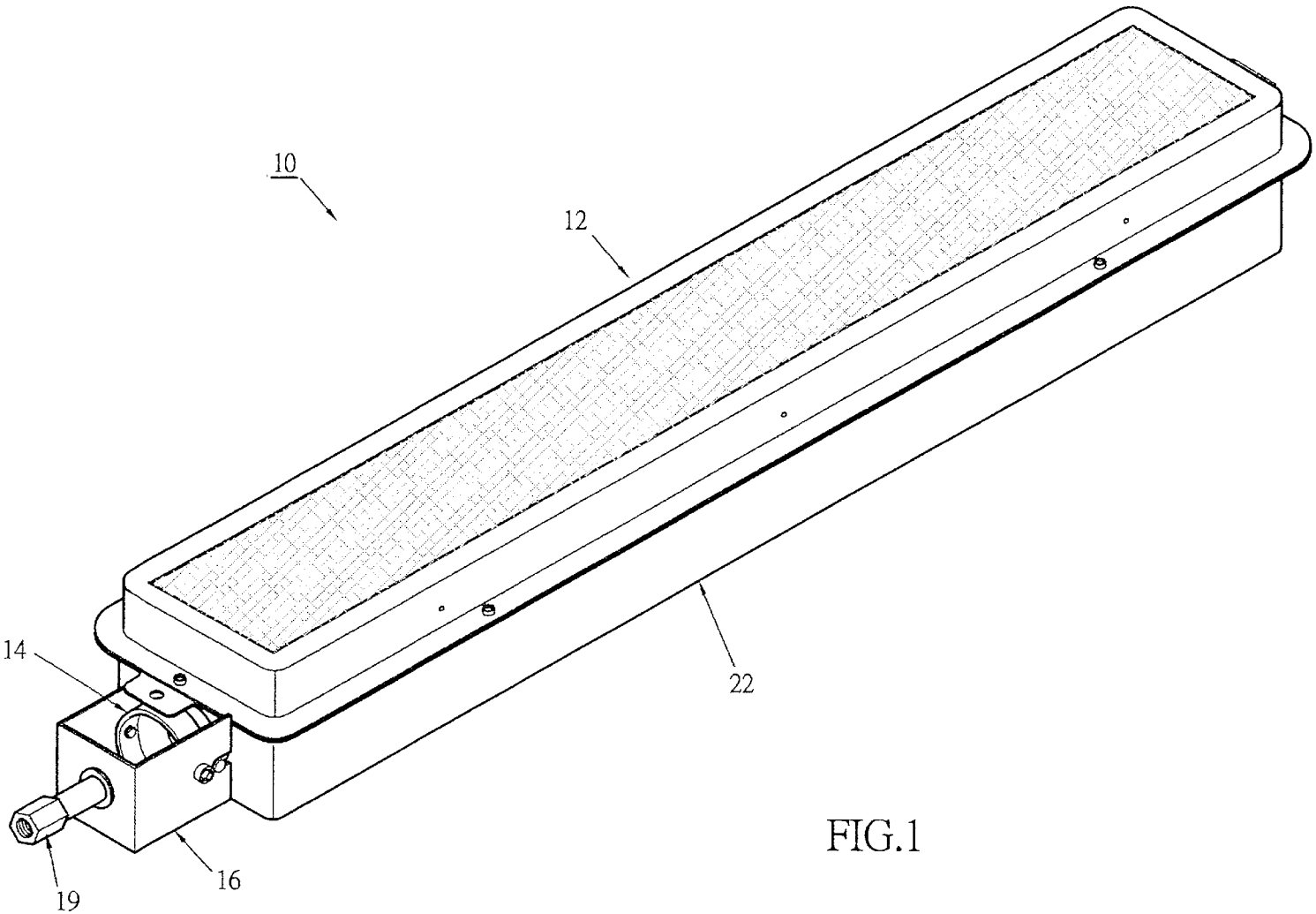
FIG. 1 is a perspective view of a first preferred embodiment of the present invention.
Figure 2:
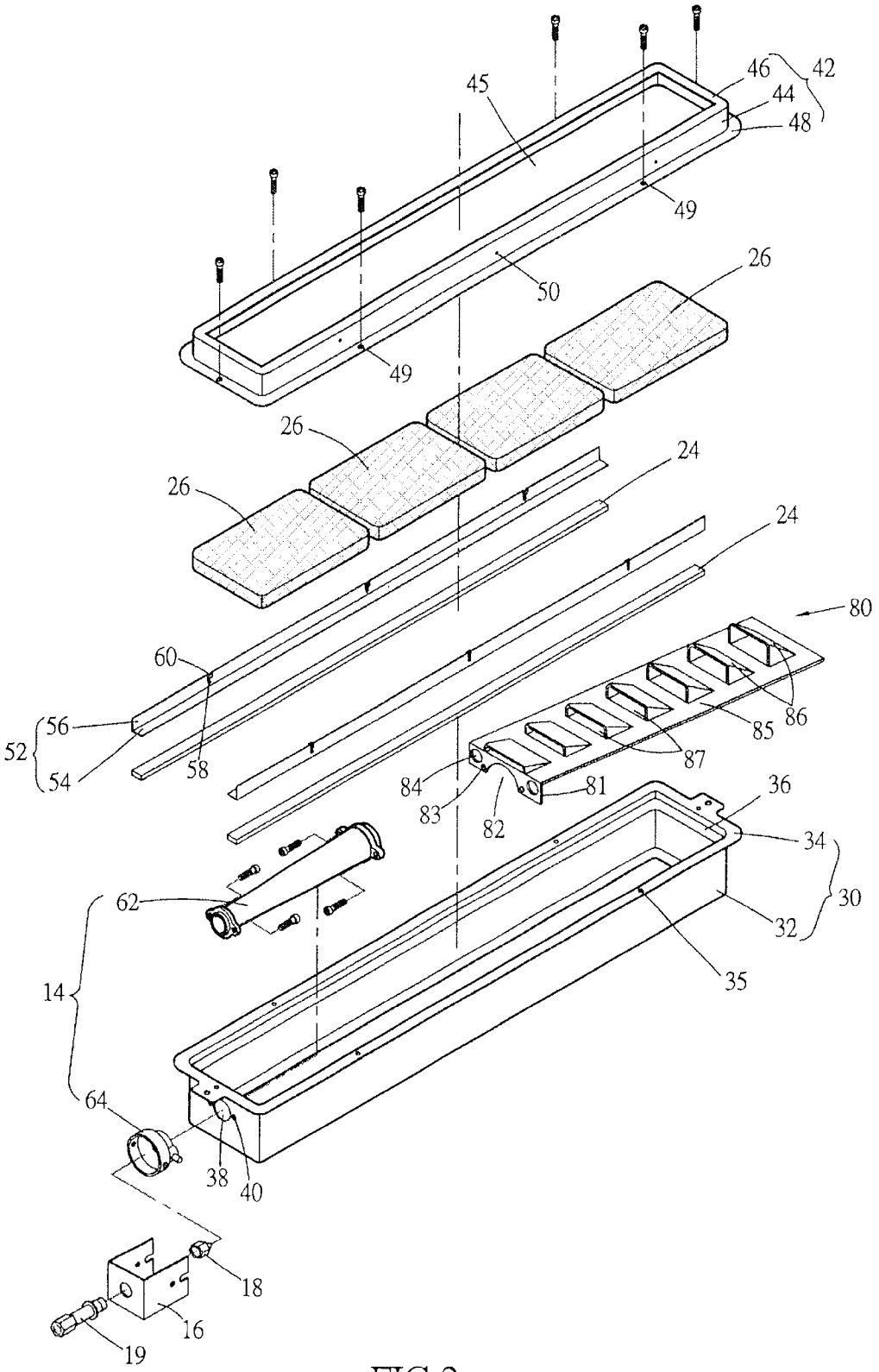
FIG. 2 is an exploded view of the first preferred embodiment of the present invention.
Figure 3:
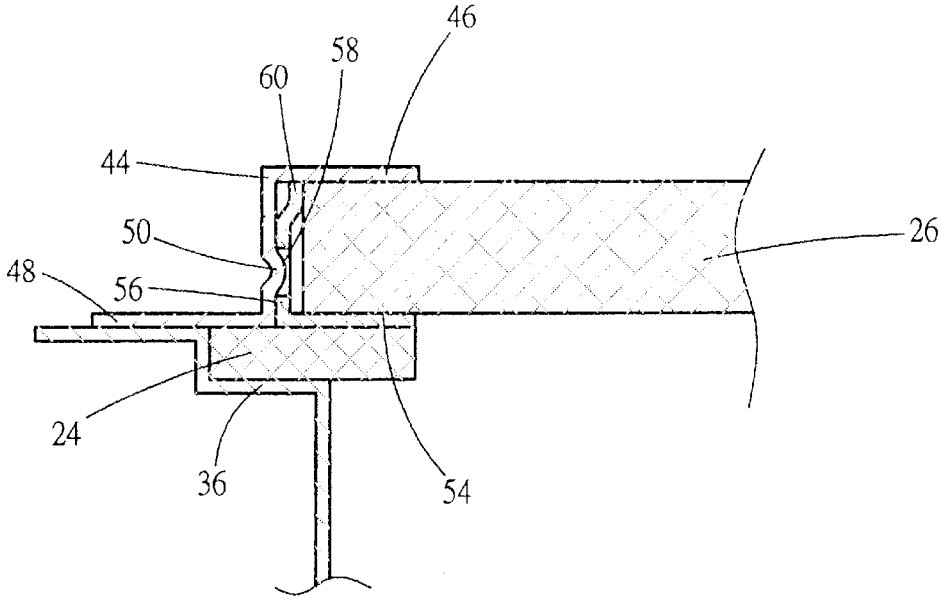
FIG. 3 is a sectional view in part of the first preferred embodiment of the present invention, showing the relationship of a cover, a support portion, a non-asbestos pad and a ceramic plank.
Figure 4:
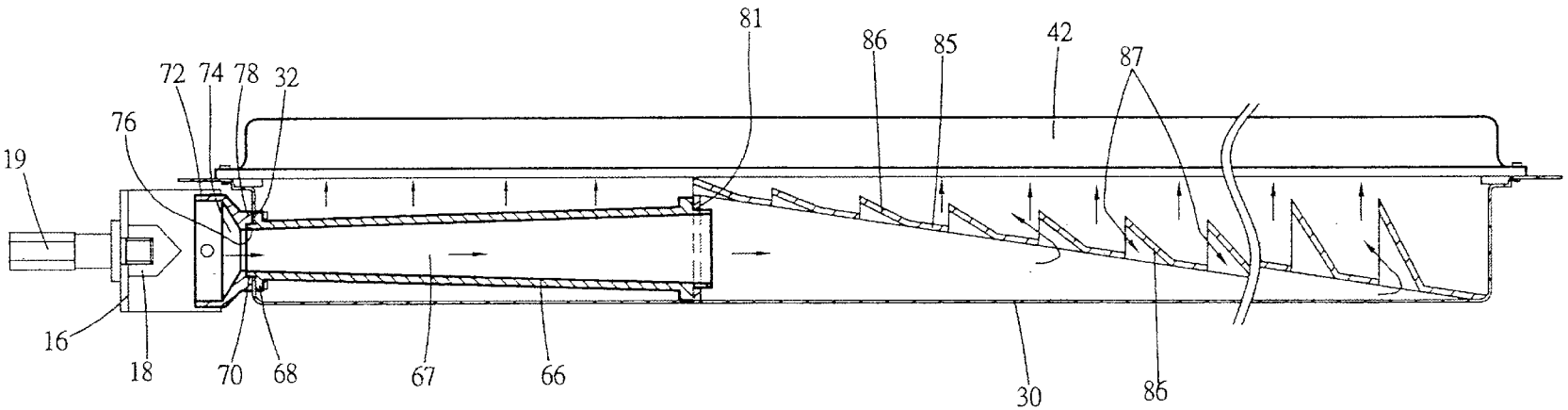
FIG. 4 is a sectional view of the first preferred embodiment of the present invention, showing the relationship of an inner tube, an outer tube and a guiding device.

Please refer to FIGS. from FIG. 1 to FIG. 4, the first preferred embodiment of the present invention provides an infrared rays gas burner 10, which mainly comprises a main member 12, a gas mixing tube 14, a frame 16, a nozzle 18 and a connector 19, wherein The main member 12 has a box 22, two non-asbestos pads 24 and a plurality of ceramic planks 26. The box 22 has a base seat 30, which has a housing portion 32 and an annular flange portion 34 with holes 35 at an opening side of the housing portion 32. An annular flat portion at the boundary of the housing portion 32 and the flange portion 34 is defined as a support portion 36. A connecting opening 38 and two lock holes 40 at opposite sides of the connecting opening 38 are provided at a front side of the housing portion 32. A cover 42 has a cap portion 44, an opening 45 at a top side of the cap portion 44, a stop portion 46 around the opening 45 and an annular flange portion 48 at a bottom side of the cap portion 44 with holes 49 thereon corresponding to the holes 35 on the flange portion 34 of the base seat 30. The cap portion 44 respectively provides plugs 50 at interior sides of lateral sides thereof. The non-asbestos pads 24 are put on the support portion 36 and the ceramic planks 26 are rested on the non-asbestos pads 24 and against by the stop portion 46. The main member 12 further has two holding pieces 52, each of which is an L-shaped cross-section bar having a horizontal piece 54 and a vertical piece 56. The holding pieces 52 is put on the base seat 30 with the horizontal pieces 54 respectively resting between the non-asbestos pads 24 and the ceramic planks 26 and the vertical pieces 56 attached on the interior sidewall of the base seat 30. The vertical pieces 56 of the holding pieces 52 are provided with gaps 58 to engage the plugs 50. Each vertical piece 56 further has an inward portion 60 to guild the plugs 50 to slide into the gaps 58.

The gas mixing tube 14 consists of an inner tube 62 and an outer tube 64. The inner tube 62 has a taper-shaped tube member 66 and a taper-shaped tunnel 67 therein. A first lock portion 68 is provided on an exterior side of the tube member 66 at the end of the tunnel 67 having smaller size with apertures on opposite sides. A first connection portion 70 is provided at a distal end of the first lock portion 68 having a size smaller than the opening 30 on the housing portion 32 of the base seat 30.

The outer tube 64 has a taped-shaped case member 72 and a taped-shaped tunnel 74 therein. A second connection portion 76 is provided on an interior side of the case member 72 at the end of the tunnel 74 having a smaller size. A second lock portion 78 is provided on a distal end of the second connection portion 76 with apertures on opposite sides. The inner tube 62 passes the first connection portion 70 through the connecting opening 38 and attaches the first lock portion 68 on the interior sidewall of the housing portion 32. The outer tube 64 engages the second connection portion 76 with the first connection portion 70 and connects the first and the second lock portions 68 and 78 and the lock holes 40 by screws to secure outer tube 64 and the inner tube 62 on the base seat 30. Because of the smaller end of the tunnel 74 of the outer tube 64 connects the smaller end of the tunnel 67 of the inner tube 62, the gas mixing tube 14 will work like a Venturi tube to increase the flow speed of the gas passing through.

The frame 16 is secured at a distal end of the outer tube 64 and the nozzle 18 and the connector 19 are provided on the frame 16.

The present invention further comprises a guiding device 80 which mainly consists of a side board 81 and a main board 85 to be an L-shaped from a lateral view. The side board 81 has an engaging opening 82, two apertures 86 at opposite sides of the engaging opening 82 respectively and two openings 84 at distal sides of the apertures 86 respectively. The main board 85 has a plurality of guiding portions 83 thereon and each guiding portion 83 has an outlet 87 facing the outer tube 64.

The way of the infrared rays gas burner 10 working is like the conventional one, and I am not going to describe the detail again. The characters of the present invention are hereunder:

In assembling, the holding pieces 52 clip the ceramic planks 26 first and squeeze them into the cover 48, such that the plugs 50 on the cap portion 44 will engage the gaps 58 of the holding pieces 52 to secure the holding pieces 52 and the ceramic planks 26 therein. Next, secure the cover on the top side of the base seat 30 by screws to finish the assembling procedures. It will be easy to understand that the assembling procedures of the infrared rays gas burner 10 of the present invention are very simple and it will not damage the ceramic planks 26 in assembling.

The ceramic planks 26 are detachable mounted in the cover 42 so that it can only replace the damaged ceramic plank(s) 26 rather than replace all of the ceramic planks 26 when any one of them was damaged. Next, the inner tube 62 and the outer tube 64 are fixedly secured on a sidewall of the base seat 30.

The gas flowed through the outer tube 64 the inner tube 62 will increase the flow speed, and the gas inject out of the inner tube 62 will spread in base seat 30 below the main board 85 and flow through the outlets 87 to the space below the ceramic planks 26. The orientations of the outlets 87 will help the gas filled in the space equally to make the ceramic planks 26 will be heated equally. The openings on the side board 81 of the guiding device 80 can let the gas flowing back.

Figure 5:
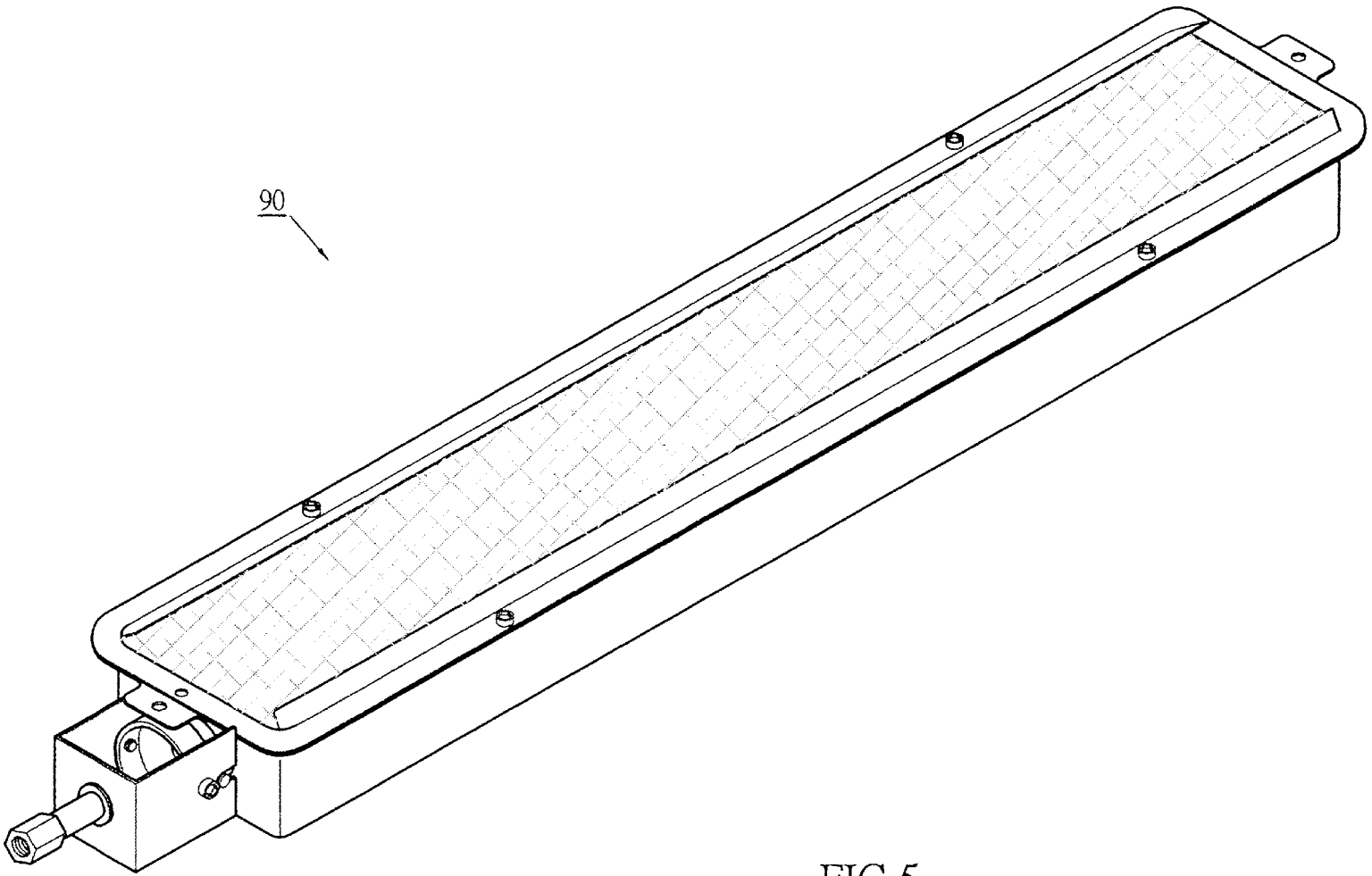
FIG. 5 is a perspective view of a second preferred embodiment of the present invention.
Figure 6:
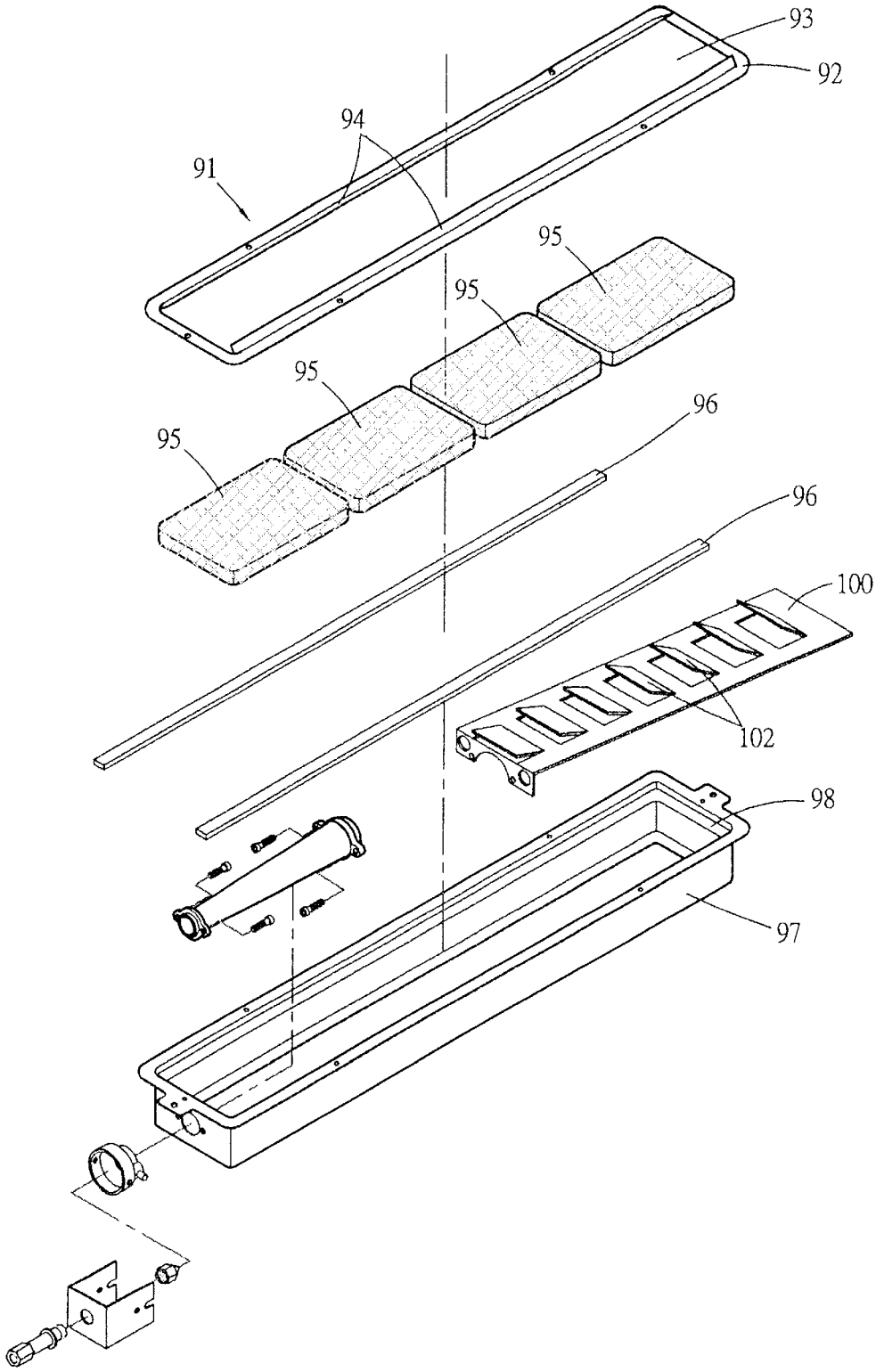
FIG. 6 is a sectional view of the second preferred embodiment of the present invention.

Please refer to FIG. 5 and FIG. 6, an infrared rays gas burner 90 of the second preferred embodiment of the present invention, which is similar to the infrared rays gas burner 10 of the first preferred embodiment, except that a cover 91 has plank member 92 with an opening 93. The plank member 92 is bent upwardly at interior sides to be two stop portions 94. The infrared rays gas burner 90 of the second preferred embodiment provides no holding piece 52 as the first preferred embodiment does so that ceramic planks 95 are attached on the non-asbestos pads 96 directly. At last, secure the cover 91 on a base seat 97 will finish the assembling procedures. The stop portions 94 of the cover 91 will be against the ceramic planks 95 to prevent them from escaping. The infrared rays gas burner 90 of the second preferred embodiment also a guiding device 100 which guiding portions 102 are made from punching. It will make the guiding device 100 can be manufactured easier.

What is claimed is:

1. An infrared rays gas burner, comprising:

a main member having a box including a base seat and a cover, at least a non-asbestos pad and at least a ceramic plank;

said base seat having an opening at a top side thereof, support portions at the top side thereof and a connecting opening and lock holes on an end thereof, and said cover includes an opening at a midsection thereof and stop portions at an edge of said opening;

said non-asbestos pad resting on said support portions of said base seat and said ceramic plank resting on said non-asbestos pad and said cover secured to said base seat with said stop portion against said ceramic plank, and a gas mixing tube having an inner tube secured on an interior side of said base seat and an outer tube secured on an exterior side of said base seat, wherein said inner tube operatively communicates with said outer tube via said connecting opening of said base seat;

said inner tube further includes a tunnel therein having a smaller size at the end thereof and operatively communicates with said outer tube and a larger size at the other end thereof, and said outer tube having a tunnel therein with a smaller size at the end thereof and operatively communicates with said inner tube and a larger size at the other end thereof.

2. The infrared rays gas burner as defined in claim 1, wherein said main member further comprises two holding pieces provided at an interior side of said cover resting in between said ceramic plank and non-asbestos pad.

3. The infrared rays gas burner as defined in claim 2, wherein each of said holding pieces further includes at least a gap and said cover has at least a plug to engage said gap.

4. The infrared rays gas burner as defined in claim 3, wherein said holding piece is provided with an inward portion closing said gap.

5. The infrared rays gas burner as defined in claim 4, wherein said holding piece is L-shaped in cross-section having a vertical piece and a horizontal piece, wherein said inward portion and said gap are provided at said vertical piece.

6. The infrared rays gas burner as defined in claim 1, wherein said cover includes a bent portion at the edge of said opening of said stop portion.

7. The infrared rays gas burner as defined in claim 1, wherein said cover includes an upwardly bent portion at the edge of said opening of said stop portion.

8. The infrared rays gas burner as defined in claim 1, wherein said base seat is provided with lock holes and said cover is provided with lock holes corresponding to said lock holes of said base seat respectively.

9. The infrared rays gas burner as defined in claim 1, wherein said inner tube has a taper-shaped tube member, a first lock portion provided at an end of said tube member and a first connection portion provided at a distal end of said first lock portion which size is smaller than said connecting hole.

10. The infrared rays gas burner as defined in claim 1, wherein said outer tube has a case member with a taper-shaped tunnel therein, a section connection portion provided at said case member at the end of said tunnel having smaller size and a second lock portion provided at a distal end of said second connection portion.

11. The infrared rays gas burner as defined in claim 1, further comprising a guiding device provided in said base seat which spreads gas injected from said inner tube in said base seat equally and said inner tube fixing an end thereof to said guiding device.

12. The infrared rays gas burner as defined in claim 11, wherein said guiding device has a side board on which said inner tube fixing to and a main board having an end thereof connecting an end of said side board and having outlets thereon.

13. The infrared rays gas burner as defined in claim 12, wherein said main board of said guiding device is provided with guiding portion thereon each of which has one of said outlets face each outer tube.

14. The infrared rays gas burner as defined in claim 12, wherein said side board of said guiding device is provided with an engaging opening, two apertures at opposite sides of said engaging opening respectively and two openings at distal sides of said apertures respectively.

* * * * *